US010655383B2

(12) United States Patent
Turner et al.

(10) Patent No.: US 10,655,383 B2
(45) Date of Patent: May 19, 2020

(54) SYSTEM AND METHOD FOR IMPLEMENTING AN IMPROVED BI-FOLD SHUTTER

(71) Applicant: Olson Kundig, Inc, Seattle, WA (US)

(72) Inventors: Phillip Turner, Mukilteo, WA (US); Tom Kundig, Seattle, WA (US); Jeremy Kramp, Gig Harbor, WA (US); Steven Rainville, Seattle, WA (US)

(73) Assignee: Olson Kundig, Inc., Seattle, WA (US)

( * ) Notice: Subject to any disclaimer, the term of this patent is extended or adjusted under 35 U.S.C. 154(b) by 185 days.

(21) Appl. No.: 15/466,679

(22) Filed: Mar. 22, 2017

(65) Prior Publication Data

US 2017/0275941 A1 Sep. 28, 2017

Related U.S. Application Data

(60) Provisional application No. 62/311,718, filed on Mar. 22, 2016.

(51) Int. Cl.
*E06B 9/02* (2006.01)
*E06B 9/06* (2006.01)
(Continued)

(52) U.S. Cl.
CPC ..... *E06B 9/0638* (2013.01); *E05D 1/00* (2013.01); *E05D 15/264* (2013.01); *E06B 3/483* (2013.01);
(Continued)

(58) Field of Classification Search
CPC .... E06B 9/0638; E06B 9/0669; E06B 9/0676; E06B 9/02; E06B 9/06; E06B 9/0607;
(Continued)

(56) References Cited

U.S. PATENT DOCUMENTS 30,587 A * 11/1860 Pennie ..... E05D 3/06 16/368
328,342 A * 10/1885 Robinson ..... E05D 3/12 160/229.1
(Continued)

FOREIGN PATENT DOCUMENTS

DE 102011121359 A1 * 6/2013 ..... E06B 3/481
EP 0207870 A2 * 1/1987 ..... E04D 13/033
(Continued)

OTHER PUBLICATIONS

Herberg, English translation of "DE102011121359" Obtained from <http://ep.espacenet.com/>. (Year: 2013).*

*Primary Examiner* — Johnnie A. Shablack
(74) *Attorney, Agent, or Firm* — Foster Garvey PC

(57) ABSTRACT

An improved bi-fold shutter that includes a more efficient coupling mechanism at a hinge point suited to facilitate opening and closing the bi-fold shutter with greater ease. In one embodiment, the shutter may be designed for a window such that the shutter, when closed, is relatively close to the face of the associated window, and when open, forms an awning or overhang. The shutter includes an improved coupling mechanism at a hinge point between a first shutter portion and a second shutter portion. The improved hinge point shifts a direction of force needed to maneuver the shutter when moving the shutter from one position to another. The shift in opening and closing force directions improves the efficiency by which the shutter can be operated. In some embodiments, the shutter may be hand-operated. In other embodiments, the shutter may be powered.

19 Claims, 4 Drawing Sheets

(51) Int. Cl.

| | |
|---|---|
| ***E06B 3/48*** | (2006.01) |
| ***E05D 1/00*** | (2006.01) |
| ***E05D 15/26*** | (2006.01) |
| *E06B 9/00* | (2006.01) |
| *E05D 3/12* | (2006.01) |
| *E05D 3/14* | (2006.01) |

(52) U.S. Cl.
CPC ..... *E06B 9/0669* (2013.01); *E05D 3/122* (2013.01); *E05D 3/14* (2013.01); *E05Y 2900/146* (2013.01); *E06B 2009/005* (2013.01)

(58) Field of Classification Search
CPC .. E06B 9/0646; E06B 2009/005; E06B 3/483; E05D 15/264; E05D 15/266; E05D 3/122; E05D 3/14; E05Y 2900/146; Y10T 16/546; Y10T 16/547; Y10T 16/5474; Y10T 16/5475; Y10T 16/5476; Y10T 16/541
USPC .... 160/207, 104, 213, 199, 206, 87; 16/366, 16/368, 369, 370
See application file for complete search history.

(56) References Cited

U.S. PATENT DOCUMENTS 495,268 A * 4/1893 Reichardt ..... E05D 3/14 16/370
498,564 A * 5/1893 Morris ..... E05D 3/12 16/366
509,702 A * 11/1893 Tangney ..... E05D 3/122 16/354
542,250 A * 7/1895 Gilman ..... E05D 3/16 16/369
563,432 A * 7/1896 Titus ..... E05D 3/06 16/368
663,219 A * 12/1900 Cross ..... E05D 13/145 16/194
862,550 A * 8/1907 Gardner ..... E05D 3/14 16/370
1,030,936 A * 7/1912 Soss ..... E05D 3/16 16/369
1,108,308 A * 8/1914 Zuckerman ..... E05D 3/16 16/369
1,180,598 A * 4/1916 Mills ..... E05D 3/06 16/368
1,235,789 A * 8/1917 Furgason ..... E05D 3/14 16/370
1,269,403 A * 6/1918 Dianovszky ..... E05D 3/16 16/369
1,282,435 A * 10/1918 Korb ..... E05D 3/18 16/360
1,382,654 A * 6/1921 Korb ..... E05D 3/14 16/370
1,610,036 A * 12/1926 Buxbaum ..... E06B 9/0638 16/258
1,697,801 A * 1/1929 Walter ..... E05D 3/16 12/142 EV
1,698,136 A * 1/1929 Lawrence ..... E05D 3/122 16/354
1,733,694 A * 10/1929 Price ..... E06B 3/483 160/190
1,797,802 A * 3/1931 Soss ..... E05D 3/16 16/369
1,810,508 A * 6/1931 Walter ..... E05D 3/16 16/369
1,939,781 A * 12/1933 Kelsey ..... E05D 15/266 160/117
1,998,319 A * 4/1935 Johnson ..... E05D 3/022 16/354
2,021,702 A * 11/1935 Soss ..... E05D 3/16 16/369
2,043,490 A * 6/1936 Redrup ..... E05D 15/262 160/191
2,072,028 A * 2/1937 Cooper ..... E05D 3/122 16/354
2,135,280 A * 11/1938 Erickson ..... E05D 3/16 16/369
2,155,116 A * 4/1939 Cox ..... E04F 10/10 160/193
2,178,271 A * 10/1939 Soss ..... E05D 3/186 16/358
2,206,708 A * 7/1940 Stumpf ..... E05D 3/06 16/358
2,235,220 A * 3/1941 Krueger ..... E06B 9/92 160/26
2,337,785 A * 12/1943 Thurman ..... E04F 10/10 160/107
2,433,583 A * 12/1947 Thurman ..... E06B 7/084 160/165
2,570,479 A * 10/1951 Pollman ..... E05D 3/14 16/370
2,611,936 A * 9/1952 Wheeler ..... E04F 10/10 160/54
2,674,452 A * 4/1954 Hummert ..... E06B 3/50 49/251
2,682,722 A * 7/1954 Waller ..... G03B 21/64 16/354
2,686,332 A * 8/1954 Moon ..... A47B 1/04 108/81
2,771,133 A * 11/1956 Haskell ..... E06B 3/483 160/107
2,777,155 A * 1/1957 Fata ..... E05D 3/14 16/357
2,860,701 A * 11/1958 Wood ..... E05D 15/266 160/199
3,425,766 A * 2/1969 Crisera ..... E05D 3/14 312/294
3,483,588 A * 12/1969 Hover ..... B63B 19/19 16/354
3,618,656 A * 11/1971 Young ..... E05D 15/262 160/189
3,881,221 A * 5/1975 Schmidt ..... E05D 3/186 16/273
3,886,627 A * 6/1975 Bassan ..... E05D 3/186 16/387
4,039,018 A * 8/1977 De Maria ..... E06B 3/2605 160/187
4,044,812 A * 8/1977 Swanstrom ..... E05D 15/264 160/118
4,056,985 A * 11/1977 Worrallo ..... E04B 2/7431 74/435
4,088,172 A * 5/1978 Pollock ..... E05D 15/262 160/193
4,224,975 A * 9/1980 Uehara ..... E05D 15/264 160/206
4,243,091 A * 1/1981 Devore ..... E05D 15/262 160/188
RE30,873 E * 3/1982 Worrallo ..... E04B 2/7431 16/354
4,499,631 A * 2/1985 Lautenschlager ..... E05D 3/142 16/370
4,545,418 A * 10/1985 List ..... E05D 15/262 160/207
4,610,289 A * 9/1986 Sugihara ..... E05D 15/24 16/232
4,620,581 A * 11/1986 Wallace ..... E06B 9/02 160/187
4,727,622 A * 3/1988 Tsuneki ..... E05D 3/16 16/354
4,817,241 A * 4/1989 Koch ..... E05D 3/16 16/238
4,848,244 A * 7/1989 Bennett ..... A47B 5/00 108/38
5,001,810 A * 3/1991 Baer ..... E05D 3/122 16/302
5,062,181 A * 11/1991 Bobrowski ..... E05D 3/122 16/234

(56) References Cited

U.S. PATENT DOCUMENTS 5,363,898 A * 11/1994 Sprague ..... E05D 13/1276 160/191
5,410,779 A * 5/1995 Esman ..... E05D 3/08 16/288
5,431,761 A * 7/1995 Holztrager ..... A47F 5/0846 156/153
5,570,971 A * 11/1996 Rixen ..... E04B 2/7427 403/381
5,601,131 A * 2/1997 Morris ..... E05B 65/0021 160/207
5,920,956 A * 7/1999 Salice ..... E05D 15/264 16/87 R
5,966,777 A * 10/1999 Jantschek ..... E04B 2/7431 16/354
6,009,930 A * 1/2000 Jantschek ..... A47G 5/00 160/135
6,056,037 A * 5/2000 Jonkman, Sr. ..... E05D 15/262 160/118
6,073,310 A * 6/2000 Baer ..... E05D 3/122 16/354
6,073,673 A * 6/2000 Janutta ..... E05D 3/08 16/288
6,470,952 B1 * 10/2002 Cline ..... E05D 15/266 160/118
6,487,755 B1 * 12/2002 Caldari ..... E05D 3/186 16/287
6,547,292 B1 * 4/2003 Keller ..... E05B 65/0021 160/193
6,574,837 B2 * 6/2003 Jantschek ..... E04B 2/7431 16/371
6,637,494 B1 * 10/2003 Nabeta ..... E05D 15/264 160/188
6,647,592 B2 * 11/2003 Presley ..... E05D 3/145 16/288
6,735,823 B2 * 5/2004 Pelletier ..... E05D 3/122 16/251
7,197,790 B1 * 4/2007 Edmondson ..... E05D 3/16 16/286
7,258,153 B2 * 8/2007 Chen ..... E05B 65/0085 16/76
7,328,481 B2 * 2/2008 Barnett ..... E05D 3/08 16/227
7,562,743 B2 * 7/2009 Beeson ..... E06B 5/20 160/216
7,565,720 B1 * 7/2009 Ligtenberg ..... G06F 1/1616 16/366
7,652,205 B2 * 1/2010 Leach ..... G10D 1/08 84/267
7,698,785 B2 * 4/2010 Bennett ..... E05D 3/16 16/239
7,754,950 B2 * 7/2010 Leach ..... G10D 1/08 16/357
7,765,644 B2 * 8/2010 Ueyama ..... G06F 1/1616 16/354
8,246,014 B2 * 8/2012 Jien ..... B63B 17/04 256/59
8,312,596 B2 * 11/2012 Self ..... A47K 3/36 16/250
8,650,713 B2 * 2/2014 Migliorini ..... E05D 3/16 16/298
8,656,623 B1 * 2/2014 Chvala ..... F41C 23/04 42/73
8,671,633 B2 * 3/2014 Haab ..... E04B 2/7401 160/206
8,714,229 B2 * 5/2014 Crown ..... E06B 3/483 160/207
8,850,661 B2 * 10/2014 Liermann ..... E05D 3/186 16/357
8,870,309 B2 * 10/2014 Chen ..... E06B 3/482 160/206
9,068,386 B2 * 6/2015 Ishii ..... E05D 15/58
9,080,379 B2 * 7/2015 Guillemette ..... E05D 15/262
9,115,531 B1 * 8/2015 Chen ..... E06B 5/003
9,249,615 B2 * 2/2016 Arteta Loredo ..... E04F 10/10
9,255,430 B2 * 2/2016 Lucas ..... E06B 9/0676
9,279,285 B2 * 3/2016 Lucas ..... E05F 15/605
9,303,443 B2 * 4/2016 Lucas ..... E04F 10/10
9,493,975 B1 * 11/2016 Li ..... E05F 5/02
9,593,525 B1 * 3/2017 Morris ..... E06B 3/483
9,609,961 B2 * 4/2017 Lindblom ..... A47F 5/101
9,951,542 B2 * 4/2018 Giglio ..... E04F 10/10
2005/0115686 A1 * 6/2005 Yedidya ..... E06B 9/0638 160/202
2007/0094846 A1 * 5/2007 Ishida ..... E05D 3/122 16/354
2008/0060274 A1 * 3/2008 Vooght ..... E05D 15/264 49/394
2009/0183447 A1 * 7/2009 Hay, III ..... E06B 9/02 52/202
2010/0282418 A1 * 11/2010 Lucas ..... E04F 10/10 160/54
2013/0213586 A1 * 8/2013 Lucas ..... E04F 10/10 160/54
2014/0185233 A1 * 7/2014 MacDonald ..... G06F 1/1681 361/679.55
2014/0224435 A1 * 8/2014 Stawski ..... E05D 15/0621 160/188
2015/0308182 A1 * 10/2015 Gionta ..... E06B 3/483 160/92
2016/0108664 A1 * 4/2016 Lucas ..... E06B 9/0638 160/188
2016/0177617 A1 * 6/2016 Liao ..... E06B 3/483 49/73.1
2016/0177622 A1 * 6/2016 Lucas ..... E06B 9/0638 160/188
2017/0016259 A1 * 1/2017 Schweiss ..... E05D 13/1223
2017/0074019 A1 * 3/2017 Schweiss ..... E05D 13/1207
2017/0074028 A1 * 3/2017 Sebastian ..... E05B 65/0085
2017/0275941 A1 * 9/2017 Turner ..... E06B 9/0638
2018/0187467 A1 * 7/2018 Schweiss ..... E05D 13/1223

FOREIGN PATENT DOCUMENTS

EP 2248980 A1 * 11/2010 ..... E06B 9/0638
FR 2956692 A1 * 8/2011 ..... E04F 10/10

* cited by examiner

SYSTEM AND METHOD FOR IMPLEMENTING AN IMPROVED BI-FOLD SHUTTER

PRIORITY CLAIM

This application claims the benefit of U.S. Provisional Application No. 62/311,718, entitled "System and Method for An Improved Bi-Fold Shutter," filed Mar. 22, 2016, which is incorporated by reference in its entirety herein for all purposes.

BACKGROUND

Architects and engineers have developed various windows, door, and window coverings in buildings for hundreds of years. Design of a window itself will usually include a way to open the window and then subsequently close the window. Similar aspects are also involved with doors and window coverings. A particular subset of window coverings is called window shutters. Window shutters may be designed to block, tune, or modulate light from coming through a window or may be designed to protect a window from severe weather. Common designs for shutters have also been around for hundreds of years.

In more modern designs, the manner in which the window shutter opens and closes may provide additional architectural or engineering features. For example, the window shutter itself may provide shade when opened or look aesthetically pleasing when in the open or closed position. However, various conventional designs of window shutters are typically clunky and somewhat difficult to operate even with motorized assistance.

BRIEF DESCRIPTION OF THE DRAWINGS

Aspects and many of the attendant advantages of the claims will become more readily appreciated as the same become better understood by reference to the following detailed description, when taken in conjunction with the accompanying drawings, wherein:

DETAILED DESCRIPTION

The following discussion is presented to enable a person skilled in the art to make and use the subject matter disclosed herein. The general principles described herein may be applied to embodiments and applications other than those detailed above without departing from the spirit and scope of the present detailed description. The present disclosure is not intended to be limited to the embodiments shown, but is to be accorded the widest scope consistent with the principles and features disclosed or suggested herein.

By way of overview, the subject matter disclosed herein may be an improved bi-fold shutter that includes a more efficient coupling mechanism at a hinge point suited to facilitate opening and closing the bi-fold shutter with greater ease. In one embodiment, the shutter may be designed for a window such that the shutter, when closed, is relatively close to the face of the associated window, and when open, forms an awning or overhang. The shutter includes an improved coupling mechanism at a hinge point between a first shutter portion and a second shutter portion. The improved hinge point shifts a direction of force needed to maneuver the shutter when moving the shutter from one position to another. The shift in opening and closing force directions improves the efficiency by which the shutter can be operated. In some embodiments, the shutter may be hand-operated. In other embodiments, the shutter may be powered. These and other aspects and features are discussed below with respect to FIGS. 1-6.

Figure 1:
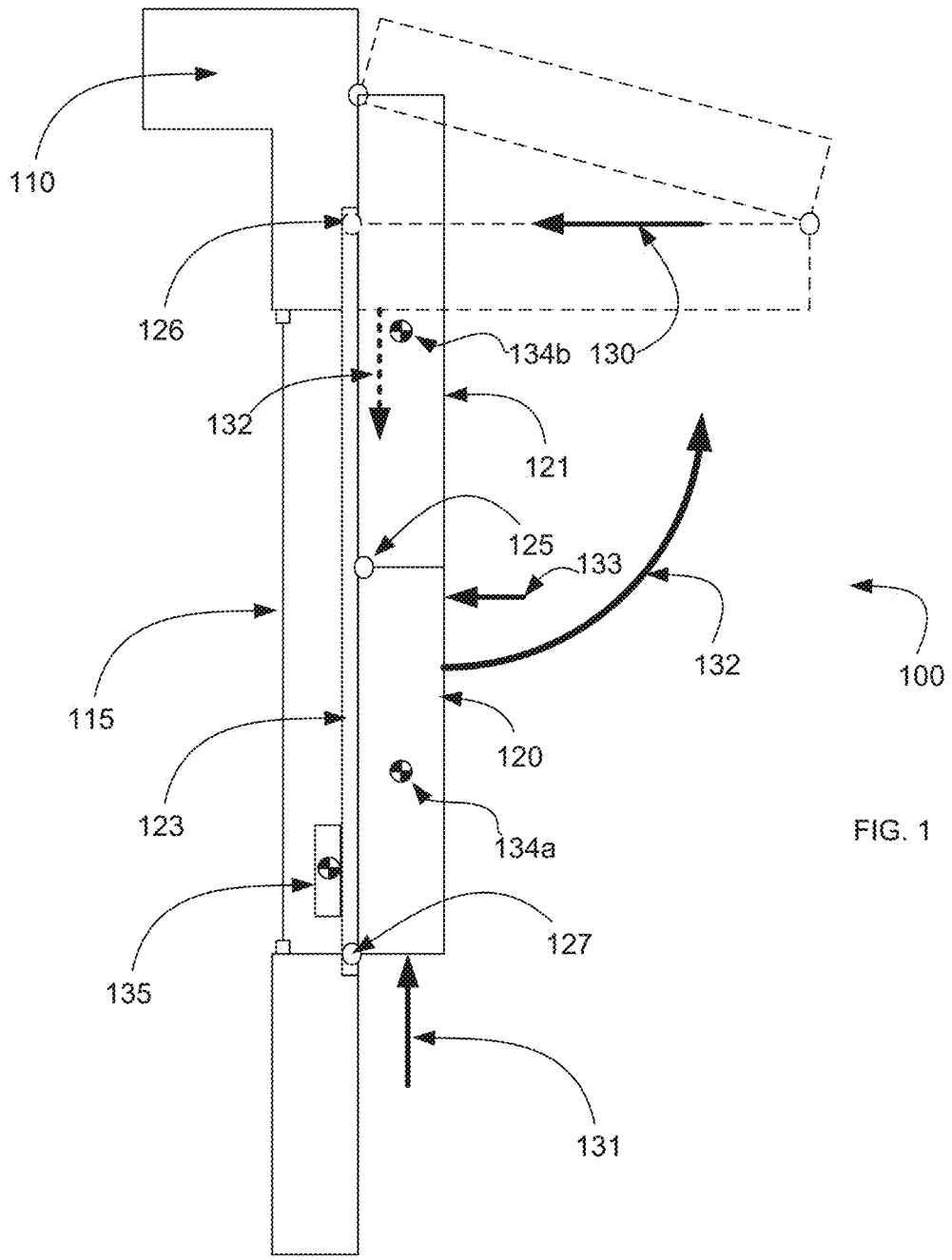
FIG. 1 PRIOR ART
FIG. 1 is a diagram of a bi-fold window shutter showing an inefficient design for the mechanism to open and close the window shutter.

FIG. 1 is a diagram of a bi-fold window shutter 100 showing an inefficient design for the mechanism to open and close the window shutter. In FIG. 1, a side view of the shutter 100 is shown in two positions relative to a window 115 of a building 110. The first position is a retracted or closed position and is shown with solid lines. The second position is an extended or open position and is shown with broken lines. The window shutter 100 of FIG. 1 is shown situated on an outer facing of the building 110 on or next to the window opening 115. Further, the window shutter 100 may include two portions. In FIG. 1, the portions include a first lower portion 120 and a second upper portion 121. The two portions may be attached to each other at a coupling point by a conventional pivoting hinge 125.

When a person wished to extend (e.g., open) the window shutter 100, a force 131 is applied in an upward direction to the lower portion 120, the two portions may swing out away from the window 115 at the coupling point hinge 125 Because the upper portion 121 is attached to the building at a stationary pivoting hinge 126, the two portions fold together into the open position shown in broken lines. This is further assisted by a guide track 123 that keeps a pin assembly 127 of the lower portion 120 in a plane parallel to the window 115.

When a person wants to retract the shutters, a force 132 may be applied in the downward direction on the lower portion 120. However, because of the pin assembly 127 and the coupling point with the pivoting hinge 125 are aligned in the same horizontal plane, there is no downward thrust force applied to the shutter itself. Rather, the thrust is only in the horizontal plane as shown by force 130. That is the downward force 132 is orthogonal to the force 130 needed to overcome any holding force of the window shutter 100 in the open position. This makes closing the shutter difficult and inefficient.

Furthermore, in the design of the window shutter 110 in FIG. 1, the locations of the coupling point hinge 125 and the stationary pivoting hinge 126, prevent the shutter from resting in a fully closed position. This is because the combined centers of gravity 134*a/b* of the first portion 120 and the second portion 121 tend to cause the window shutter 100 to rest is a slightly askew and open position. If a force 133 is applied to the shutters to remain closed, the shutter portions 120 and 121 may bind in place and be difficult to wrest open again.

Further disadvantages of the window shutter 100 of FIG. 1 are numerous. Various part of the overall assembly protrude into the building interior as one or more additional counterweights 135 are needed. As the window shutter 100 tends to lock into place at the open position, additional devices (not shown) are needed to initiate the closing maneuver. Even further devices (also not shown) may be needed to apply enough force to fully close the window shutter 100. The lower portion of the window shutter 100 typically cannot be raised to a fully horizontal position which is displeasing to the discerning eye. Unsightly and bulky operating mechanisms haunt the designer's vision when the window shutter 100 of FIG. 1 is deployed. Complex hydraulic systems and electrical operators cause additional inefficiencies and maintenance and also require power for both opening and closing maneuvers. Additional drawbacks exist but are not enumerated for the sake of brevity.

Figure 2:
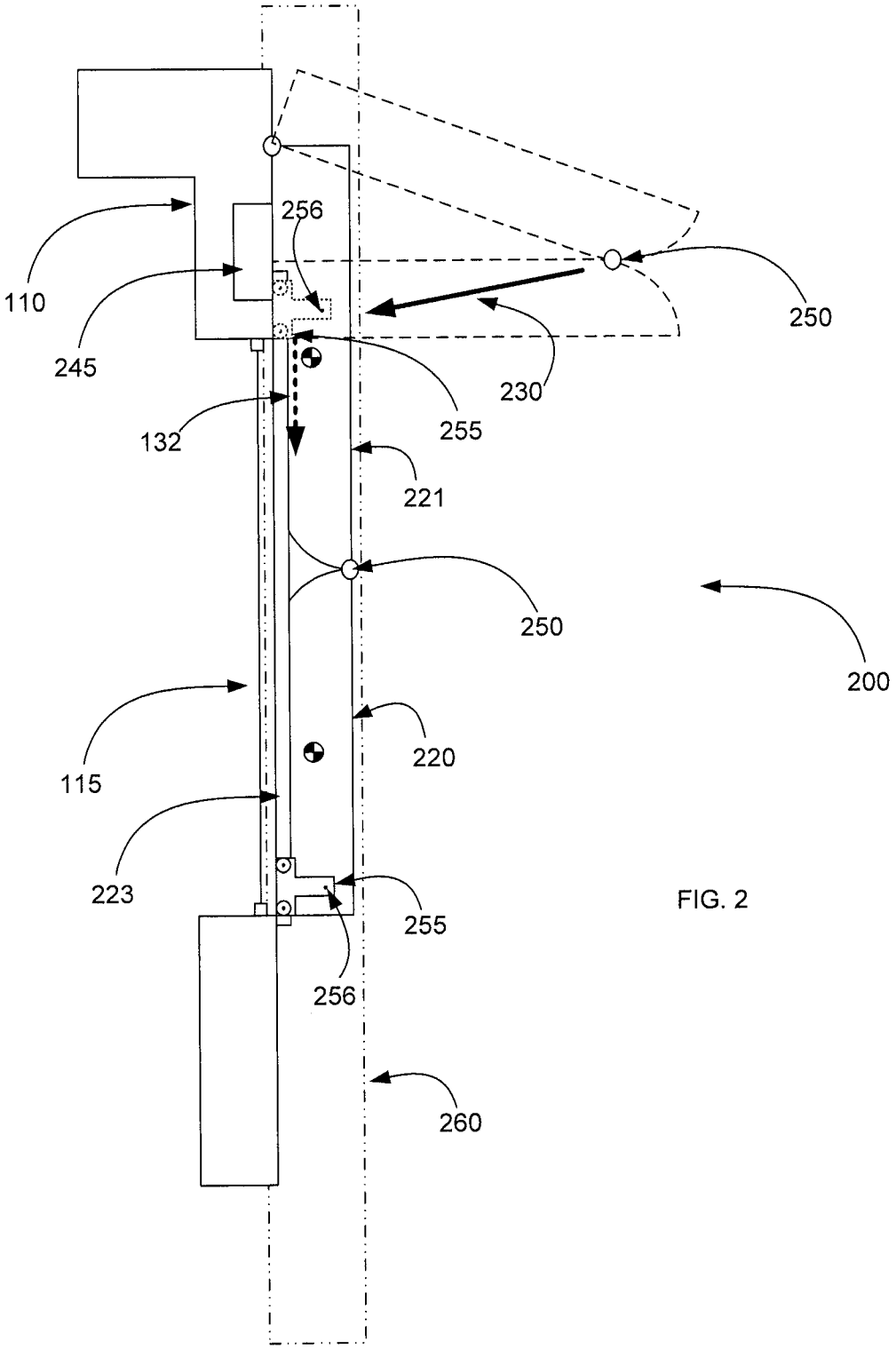
FIG. 2 is a diagram of an improved bi-fold window shutter showing a more efficient design for the mechanism to open and close the window shutter according to an embodiment of the subject matter disclosed herein.

FIG. 2 is a diagram of an improved bi-fold window shutter 200 showing a more efficient design for the mechanism to open and close the window shutter 200 according to an embodiment of the subject matter disclosed herein. The window shutter 200 in this embodiment includes a first lower portion 220 (e.g., a first rigid member) and a second upper portion 221 (e.g., a second rigid member) that are coupled together at a coupling utilizing a variable center hinge (shown in greater detail in FIGS. 3-6 below). The variable center hinge provides for a coupling point 250 between an upper end of the lower portion 221 and a lower end of the upper portion 220 of the window shutter 200, such that the coupling point 250 may move relative to the two portions of the window shutter 200 when in motion. As is shown in FIGS. 3-6, the center of rotation (e.g., the moving pivot point 250) of the variable center hinge shifts during maneuvering from near the outer face of the frame (as is shown in the closed shutter position) to near the inner face of the frame (as is shown in the open shutter position). That is, the coupling point 250 is between the first end of the first rigid member and the first end of the second rigid member wherein the coupling point 250 includes a rotation point that moves relative to the first end of the first rigid member 221 and relative to the first end of the second rigid member 220.

In this manner, the non-coupling ends of the window shutter 200 (e.g., the second end (the lower end) of the first rigid member 221 and the second end (the upper end) of the second rigid member 220 are fix within a vertical plane of motion 260 that is parallel with the window 115 and the guide track 223. This plane 260 is disposed such that the second end of the first rigid member 220 and the second end of the second rigid member 221 remain in the plane 260 during window shutter 200 motion and disposed such that the coupling 250 deviates from the plane 260 during window shutter 200 motion.

The window shutter 200 is supplemented with a lower roller assembly 255 that assists with overcoming the coefficient of friction when maneuvering the window shutter 200 from position to position. The roller assembly 255 includes wheels that remain in a plane of motion 260 parallel to the window 115. In an embodiment, the wheels are encompassed in the guide track 223. As the window shutter 200 moves to the open position, the window shutter 200 rotates about a pivot point 256 at the lower end (e.g., a second end opposite the first end at the upper end) of the lower portion 220.

The variable center hinge and the roller assembly 255 assist with reducing the force needed to maneuver the window shutter 200—especially when is a fully open or fully closed position. One reason for the reduction in force is that the thrust force 230 needed to move the shutter 200 out of the fully open position is now angled with respect to a normal of the plane of motion 260. This is because the rotation point 250 moves relative to the windows shutter portions 220 and 221. Thus, when in the fully open position, the thrust force 230 is angled from the center of rotation point 250 to the roller assembly 255 pivot point 256 so that at least some of the downward force 132 used to attempt to close the window shutter 200 is translated to this force angle 230. In some embodiments, the window assembly may include a motor 245 configured to actuate the window shutter from an extended position to a retracted position and configured to actuate the window shutter from the retracted position to the extended position.

The embodiments of the coupling are discussed next with respect to FIGS. 3-6 and provide a better understanding of the rotation point being relative to the motion of the window shutter members 220 and 221.

Figure 3:
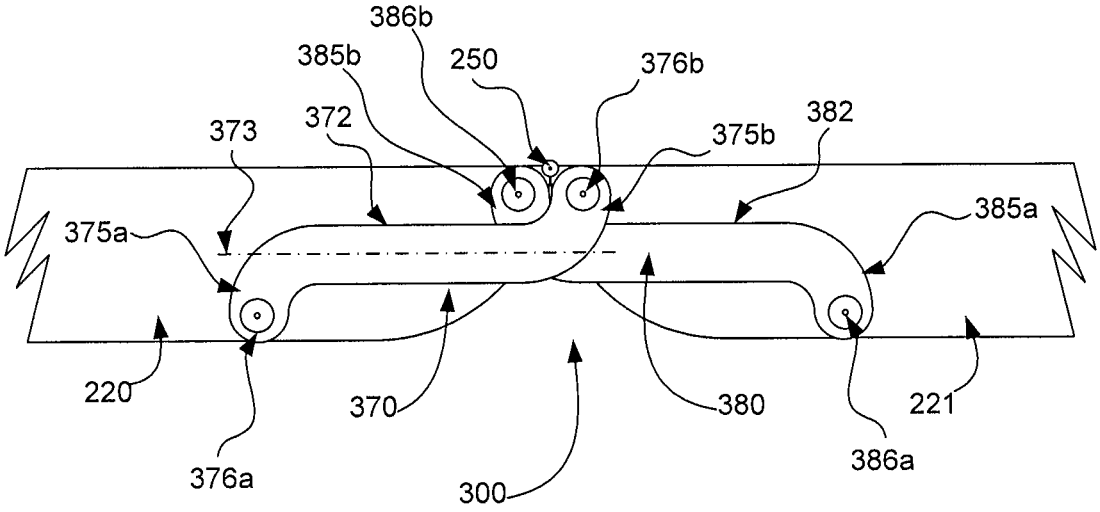
FIG. 3 is a diagram of an improved hinge mechanism for the bi-fold window shutter of FIG. 2 in a retracted position according to an embodiment of the subject matter disclosed herein.

FIG. 3 is a diagram of an improved hinge mechanism 300 for the bi-fold window shutter of FIG. 2 in a closed position according to an embodiment of the subject matter disclosed herein. The improved hinge mechanism 300 (sometimes called a variable center hinge) provides the coupling between portions 220 and 221 of the window shutter of FIG. 2 and includes a first member 370 and a second member 380. Each member 370 and 380 includes an elongated center portion 372 and 382 that each culminate in two protruding ends 375*a/b* and 385*a/b*. With respect to the first member 370, the protruding ends 375*a/b* may protrude away from the elongated center portion 372 in opposite angled directions with respect to a center line 373 of the elongated center portion 372. With respect to the second member 380, the protruding ends 385*a/b* may protrude away from the elongated center portion 382 in similar opposite angled directions with respect to a center line (not shown) of the elongated center portion 382.

In this embodiment, one protruding end 375*a* of the first member 370 is pivotally attached (at pivot point 376*a*) to an end of the lower section 220 of the window shutter 200 and the other protruding end 375*b* of the first member 370 is pivotally attached (at pivot point 376*b*) to an end of the upper portion 221 of the window shutter 200. In an opposite manner (mirror-image in the retracted position), one protruding end 385*a* of the second member 380 is pivotally attached (at pivot point 386*a*) to an end of the lower section 220 of the window shutter 200 and the other protruding end 375*b* of the second member 380 is pivotally attached (at pivot point 386*b*) to an end of the upper portion 221 of the window shutter 200. Further, the two members 370 and 380 may be nested such that one protruding end 375*b* of a first member 370 nests around (e.g., on the outside of) a protruding end 385*b* of the second member 380 as shown.

In this manner, when in the closed position (e.g., retracted), the relative coupling point 250 is aligned with the outer edge (top edge with respect to the alignment of the window shutter as depicted in FIG. 3). However, as the window shutter 200 begins to move into an open position, the coupling point 250 will move along a range of motion at the ends of the portions 220 and 221 of the window shutter 200 in manner relative to the motion of the ends of the window shutter members 220 and 221. This can be seen in FIG. 4 when the window shutter 200 is maneuvered to an open position (e.g., extended).

Figure 4:
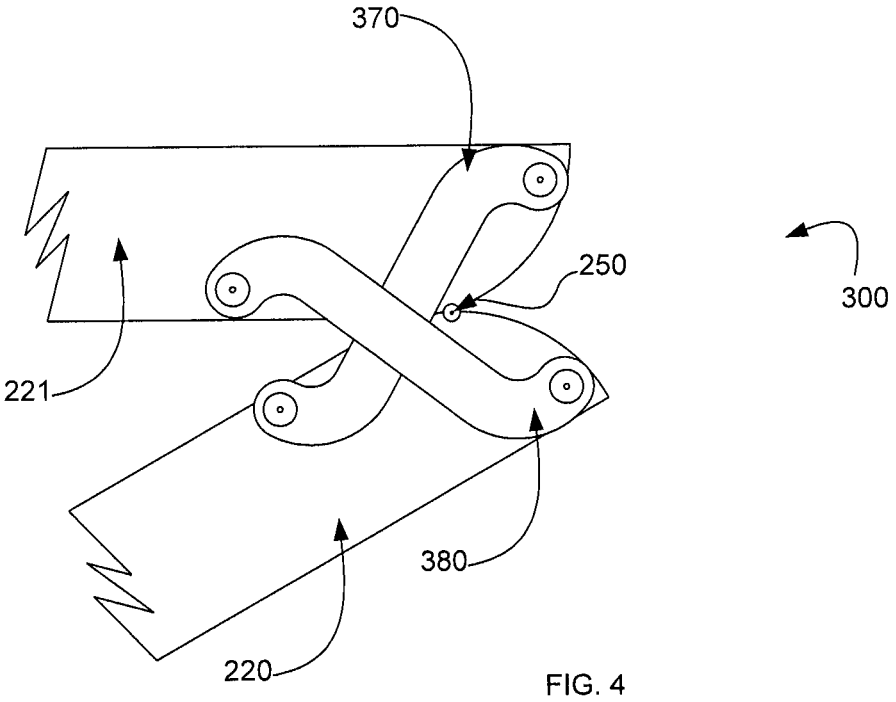
FIG. 4 is a diagram of an improved hinge mechanism for the bi-fold window shutter of FIG. 2 in an extended position according to an embodiment of the subject matter disclosed herein.

FIG. 4 is a diagram of the improved hinge mechanism 300 of FIG. 3 for the bi-fold window shutter 200 of FIG. 2 in an open position according to an embodiment of the subject matter disclosed herein. As the improved hinge mechanism 300 is maneuvered, the protruding ends 375*a/b* and 385*a/b* of each member 370 and 380 pivot about the attached pivoting points 376*a/b* and 386*a/b* at each end of each shutter portion 220 and 221. FIG. 4 shows the variable center hinge 300 in an open shutter position so that one can see that the relative rotation point 250 has now moved along the coupling to be located away from the outer edge of the window shutter 200.

Figure 5:
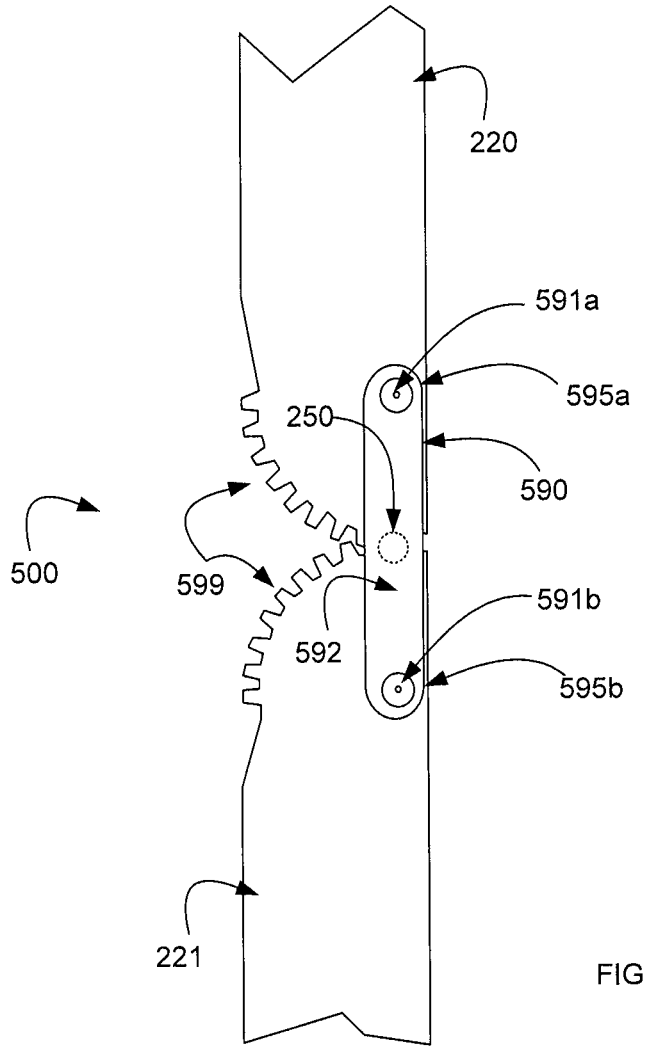
FIG. 5 is a diagram of another improved hinge mechanism for the bi-fold window shutter of FIG. 2 in a retracted position according to an embodiment of the subject matter disclosed herein.

FIG. 5 is a diagram of another improved hinge mechanism 500 for the bi-fold window shutter of FIG. 2 in a retracted position according to an embodiment of the subject matter disclosed herein. The improved hinge mechanism 500 provides the coupling between portions 220 and 221 of the window shutter of FIG. 2 and includes a member 590 that is coupled at respective pivot points 591*a/b* on each respective portion 220 and 221. The member 590 includes an elongated center portion 592 that each culminate in two ends 595*a/b*.

In this embodiment, one end 595*a* of the member 590 is pivotally attached (at pivot point 591*a*) to an end of the lower section 220 of the window shutter 200 and the other end 595*b* of the member 390 is pivotally attached (at pivot point 591*b*) to an end of the upper portion 221 of the window shutter 200. In this manner, when in the closed position (e.g., retracted), the relative coupling point 250 is aligned with the outer edge. However, as the window shutter 200 begins to move into an open position, the coupling point 250 will move along a range of motion at the ends of the portions 220 and 221 of the window shutter 200 in manner relative to the motion of the ends of the window shutter members 220 and 221. This can be seen in FIG. 6 when the window shutter 200 is maneuvered to an open position (e.g., extended).

The embodiment of FIG. 5 may include additional interweaving teeth 599 that may assist with facilitating the move from open to closed position or from the closed to open position. Various embodiment may also have a different shape of hinged member 590 for facilitating the pivoting and the coupling.

Figure 6:
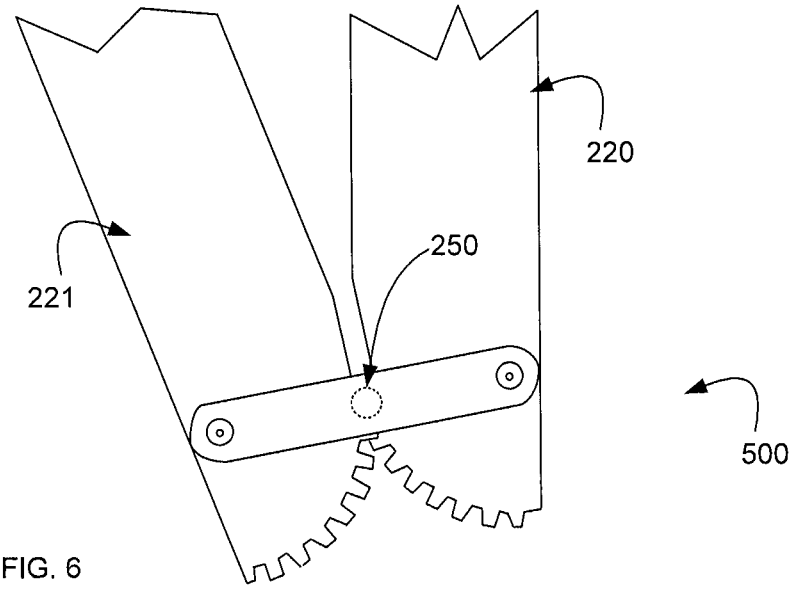
FIG. 6 is a diagram of another improved hinge mechanism for the bi-fold window shutter of FIG. 2 in an extended position according to an embodiment of the subject matter disclosed herein.

FIG. 6 is a diagram of another improved hinge mechanism 500 for the bi-fold window shutter 200 of FIG. 2 in an extended position according to an embodiment of the subject matter disclosed herein. As the improved hinge mechanism 500 is maneuvered, the ends 595*a/b* of the member 590 pivot about the attached pivot points 591*a/b* at each end of each shutter portion 220 and 221. FIG. 6 shows the variable center hinge 500 in an open shutter position so that one can see that the relative rotation point 250 has now moved along the coupling to be located away from the outer edge of the window shutter 200.

While the subject matter discussed herein is susceptible to various modifications and alternative constructions, certain illustrated embodiments thereof are shown in the drawings and have been described above in detail. It should be understood, however, that there is no intention to limit the claims to the specific forms disclosed, but on the contrary, the intention is to cover all modifications, alternative constructions, and equivalents falling within the spirit and scope of the claims.

What is claimed is:

1. A window shutter, comprising:

A first shutter member having a first end and a second shutter member having a first end;

a first hinge member having a first end and a second end;

a second hinge member having a first end and a second end;

a coupling between the first end of the first shutter member and the first end of the second shutter member, the coupling utilizing a blockless variable center hinge wherein the coupling includes a rotation point that moves relative to the first end of the first shutter member and relative to the first end of the second shutter member and further wherein the rotation point is located at a point at an outer face of the shutter when the first shutter member and second shutter member are in a closed position; and the blockless variable center hinge wherein the first-hinge member includes an elongated center portion and further wherein the first and second end of the first hinge member comprise angled protruding ends, and the second hinge member includes an elongated center portion and further wherein the first and second ends of the second hinge member comprise angled protruding ends and wherein the first member and second member directly connect to the first and second shutter members.

2. The window shutter of claim 1, further comprising a plane of motion disposed such that the second end of the first shutter member and the second end of the second shutter member remain in the plane of motion during window shutter motion and disposed such that the coupling deviates from the plane of motion during window shutter motion.

3. The window shutter of claim 1, wherein:

the first angled protruding end of the first hinge member is pivotally coupled to a first end of the first shutter member;

the second angled protruding end of the first hinge member is pivotally coupled to a second end of the second shutter member;

the first angled protruding end of the second hinge member is pivotally coupled to a first end of the second shutter member;

the second angled protruding end of the second hinge member is pivotally coupled to a second end of the first shutter member.

4. The window shutter of claim 1, wherein the first hinge member and the second hinge member are nested such that one protruding end the first hinge member nests around one protruding end of the second hinge member.

5. The window shutter of claim 1, wherein the second end of the first shutter member is coupled to a stationary pivot point so that the second end remains fixed about the stationary pivot point during motion.

6. The window shutter of claim 1, wherein the second end of the second shutter member comprises a roller assembly pivotally attached to the second end of the second shutter member.

7. The window shutter of claim 1, wherein the first end of the first shutter member and the first end of the second shutter member comprise curved contours.

8. The window shutter of claim 1, wherein the first end of the first shutter member and the first end of the second shutter member comprise interweaving teeth.

9. The window shutter of claim 1, wherein the first end of the first shutter member and the first end of the second shutter member comprise a rigid wood material.

10. A window assembly, comprising:

a window frame;

a window fixed in the window frame;

a window shutter coupled to the window frame, the window shutter including:

a first shutter member having a first end and a second end;

a second shutter member having a first end and a second end;

a coupling between the first end of the first shutter member and the first end of the second shutter member wherein the coupling includes a rotation point that moves relative to the first end of the first shutter member and relative to the first end of the second shutter member; and further wherein the rotation point is located at a point at an outer face of the shutter when the first shutter member and second shutter member are in a closed position; and the coupling further comprising a blockless variable center hinge wherein a first hinge member includes an elongated center portion and further wherein the first and second ends of the first hinge member comprise angled protruding ends, and a second hinge member includes an elongated center portion and further wherein the first and second ends of the second hinge member comprise angled protruding ends and wherein the first member and second member directly connect to the first and second shutter members.

11. The window assembly of claim 10, further comprising a plane of motion parallel to the window disposed such that the second end of the first shutter member and the second end of the second shutter member remain in the plane of motion during window shutter motion and disposed such that the coupling deviates from the plane of motion during window shutter motion.

12. The window assembly of claim 10, further comprising a motor configured to actuate the window shutter from an extended position to a retracted position and configured to actuate the window shutter from the retracted position to the extended position.

13. The window assembly of claim 10, wherein:

the first angled protruding end of the first hinge member is pivotally coupled to a first end of the first shutter member;

the second angled protruding end of the first hinge member is pivotally coupled to a second end of the second shutter member;

the first angled protruding end of the second hinge member is pivotally coupled to a first end of the second shutter member;

the second angled protruding end of the second hinge member is pivotally coupled to a second end of the first shutter member.

14. The window assembly of claim 10, wherein the first hinge member and the second hinge member are nested such that one protruding end of the first member nests around one protruding end of the second member.

15. The window assembly of claim 10, wherein the second end of the second shutter member comprises a roller assembly pivotally attached to the second end of the second shutter member and translationally coupled to a guide track affixed to the window frame.

16. The window assembly of claim 10, wherein the first end of the first shutter member and the first end of the second shutter member comprise curved contours.

17. The window assembly of claim 10, wherein the first end of the first shutter member and the first end of the second shutter member comprise interweaving teeth.

18. The window assembly of claim 10, wherein the first end of the first shutter member and the first end of the second shutter member comprise a rigid wood material.

19. A window assembly, comprising:

a window frame;

a window fixed in the window frame;

a window shutter coupled to the window frame, the window shutter comprising two shutter members, each movable relative to the window frame by a blockless variable center hinge, the blockless variable center hinge comprising:

a first hinge member having a first end and a second end separated by an elongated center portion, and wherein the first and second ends of the first member comprise opposing angled protruding ends, the protruding ends coupled to opposite shutter members;

a second hinge member having a first end and a second end separated by an elongated center portion, and wherein the first and second ends of the second hinge member comprise opposing angled protruding ends, each protruding end coupled to opposite shutter members;

a coupling between the the two shutter members wherein the coupling includes a rotation point that moves relative to a first end of the first shutter member and relative to a first end of the second shutter member and further wherein the rotation point is located at a point at an outer face of the shutter when the first shutter member and second shutter member are in a closed position.

* * * * *